United States Patent [19]

Hama et al.

[11] Patent Number: 4,507,938

[45] Date of Patent: Apr. 2, 1985

[54] SYSTEM FOR AIR-CONDITIONING AND HOT WATER SUPPLYING

[75] Inventors: Hiroaki Hama; Toshiro Abe, both of Wakayama, Japan

[73] Assignee: Mitsubishi Denki Kabushiki Kaisha, Tokyo, Japan

[21] Appl. No.: 530,354

[22] Filed: Sep. 8, 1983

[30] Foreign Application Priority Data

Sep. 10, 1982 [JP] Japan ..... 57-159163

[51] Int. Cl.[3] ..... F25B 13/00

[52] U.S. Cl. ..... 62/324.1; 62/238.6; 237/2 B; 165/58

[58] Field of Search ..... 237/2 B, 19; 62/238.6, 62/79, 335, 324.1; 165/18, 58

[56] References Cited

U.S. PATENT DOCUMENTS

| | | | |
|---|---|---|---|
| 3,301,002 | 1/1967 | McGrath | 62/185 |
| 3,984,050 | 10/1976 | Gustafsson | 62/238.6 |
| 4,155,506 | 5/1979 | Brosenius | 237/19 |
| 4,391,104 | 7/1983 | Wendschlag | 62/238.6 |

*Primary Examiner*—Henry Bennett

*Attorney, Agent, or Firm*—Oblon, Fisher, Spivak, McClelland & Maier

[57] ABSTRACT

An air-conditioning and hot water supply system, which comprises a heat pump type refrigerating device at the primary side having a user side heat-exchanger and a heat source side heat-exchanger with a coolant of excellent low temperature characteristic being filled in both of them; a refrigerating device at the secondary side having a user side condenser for heating water for hot water supply and a heat source side evaporator with a coolant of excellent high temperature characteristic being filled in both of them; fan coil units for air-conditioning communicatively connected with the user side heat-exchanger of the heat pump type refrigerating device at the primary side and the heat source side evaporator of the refrigerating device at the secondary side; and a circuit for air-conditioning, through which cold or warm water is caused to circulate between the user side heat exchanger and the heat source side evaporator, the cold water or warm water after the air-conditioning operation by the fan coil units being circulated in the heat source side evaporator of the refrigerating device at the secondary side and the user side heat exchanger of the heat pump type refrigerating device at the primary side.

11 Claims, 4 Drawing Figures

SYSTEM FOR AIR-CONDITIONING AND HOT WATER SUPPLYING

This invention relates to a system for room warming and hot water supplying capable of performing room warming and simultaneous hot water supplying.

There has so far been known in general a system, by which air-conditioning and hot water supplying are carried out by a single refrigerating device. In such known system, temperature of the hot water supply is approximately 60° C. at its highest from the standpoint of characteristics of the device, on account of which the hot water supply of a temperature as high as approximately 80° C. is obtained in combination with a combustion device.

From the aspects of combustion efficiency, operational safety, etc. of the system, however, there has been a demand for obtaining the hot water supply at such high temperature by a refrigerating system which is totally operated with electricity.

The present invention has been made in view of the above-mentioned situation, and aims at providing an air-conditioning and hot water supplying system which is capable of performing room cooling and warming and hot water supplying by combining two units of refrigerating device.

According to the present invention, in general aspect of it, there is provided an air-conditioning and hot water supplying system, which comprises: a heat pump type refrigerating device at the primary side having a user side heat-exchanger and a heat source side heat-exchanger with a coolant of excellent low temperature characteristic being filled therein; and another refrigerating device at the secondary side having a user side condenser for heating water for hot water supply and a heat source side evaporator with a coolant of excellent high temperature characteristic being filled therein; fan coil units for the air-conditioning communicatively connected with said user side heat-exchanger of said heat pump type refrigerating device at the primary side and said heat source side evaporator of said refrigerating device at the secondary side; and a circuit for air-conditioning, through which cold water or warm water is caused to circulate between said user side heat exchanger and said heat source side evaporator, the cold water or warm water after the air-conditioning operation by said fan coil units being caused to circulate in said heat source side evaporator of the refrigerating device at the secondary side and said user side heat exchanger of said heat pump type refrigerating device at the primary side.

The foregoing object, other objects as well as specific construction and operations of the air-conditioning and hot water supplying system according to the present invention will become more apparent and understandable from the following detailed description thereof, when read in conjunction with the accompanying drawing.

In the following, the construction of the preferred embodiment of the air-conditioning and hot water supplying system according to the present invention will be explained in detail in reference to the accompanying drawing.

Figure 1:
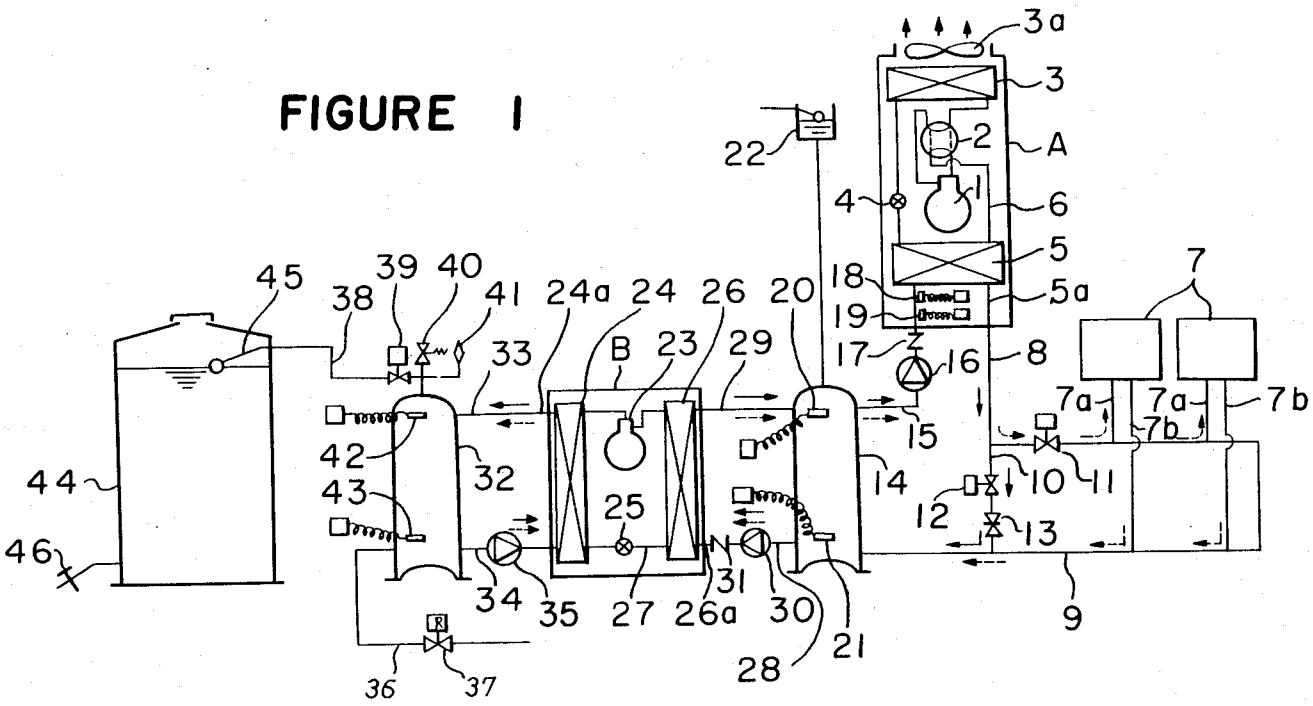
FIG. 1 is a schematic constructional diagram of one preferred embodiment of the air-conditioning and hot water supplying system according to the present invention.

In FIG. 1, a reference numeral 1 designates a compressor; a numeral 2 refers to a four-way change-over valve, a numeral 3 refers to a heat source side heat-exchanger having an air blower 3*a;* a reference numeral 4 denotes an expansion device; a numeral 5 refers to a user side heat-exchanger having a water circuit 5*a;* and a reference numeral 6 represents a refrigerant piping which connects the above-mentioned component parts 1, 2, 3, 4, and 5 to form a heat-pump type refrigerating device A at the primary side. For the coolant within the cycle of the heat-pump type refrigerating device A, Freon 22 (R22) is filled in. A reference numeral 7 designates a fan coil unit to perform cooling and warming of a room; a numeral 8 refers to the first connecting pipe for the air-conditioning circuit, which connects an outlet of the water circuit 5*a* and an inlet 7*a* of the fan coil unit 7; a numeral 9 refers to the second connecting pipe for the air-conditioning circuit, which is connected with an outlet 7*b* of the fan coil unit 7; a numeral 10 refers to a by-pass pipe connecting the first and second connecting pipes 8 and 9; numerals 11 and 12 respectively refer to the first and second electromagnetic valves which are provided in the first connecting pipe 8 and the by-pass pipe 10 in the neighborhood of these first connecting pipe 8 and the by-pass pipe 10; a reference numeral 13 represents a flowrate regulating valve provided in the by-pass pipe 10; a reference numeral 14 denotes a cushion tank of a predetermined capacity, the bottom part of which is connected to the second connecting pipe 9; a reference numeral 15 represents the third connecting pipe for the air-conditioning circuit, which connects the upper part of the cushion tank 14 and the inlet of the water circuit 5*a;* numerals 16 and 17 respectively refer to a circulating pump for air-conditioning and a check valve both being provided in the third connecting pipe 15. The check valve 17 permits flow of water only in the direction of from the cushion tank 14 to the user side heat-exchanger 5. Reference numerals 18 and 19 respectively denote a temperature detector for cooling and a temperature detector for warming, both being provided at the inlet side of the water circuit 5*a*. The temperature detector 18 for cooling is opened at a temperature of water of, for example, 12° C. or below and closed at a temperature of 15° C. or above, while the temperature detector 19 for warming is opened at a temperature of water of, for example, 50° C. or above and is closed at a temperature of 47° C. or below, thereby controlling operations of the heat-pump type cooling device A. Reference numerals 20 and 21 respectively indicate a temperature detector for cold water and a temperature detector for warm water to detect a temperature of the circulating water in the upper part and the lower part of the cushion tank 14. The temperature detector 20 for cold water is opened at a temperature of the water of, for example, 7° C. or below and is closed at a temperature of 13° C. or above, while the temperature detector 21 for warm water is opened at a temperature of water of, for example, 45° C. or above and closed at a temperature of 35° L C. or below, thereby controlling operations of the circulating pump 16 for the air-conditioning and a circulating pump for heat source (to be explained hereinafter). A numeral 22 refers to a cistern tank, one end of which is communicatively connected with the upper part of the cushion tank 14 and the other end of which is communicatively connected with a water supply source (not shown in the drawing). This cistern tank functions to replenish the circulating water in the cushion tank 14 when its quantity becomes reduced. A numeral 23 refers to a compressor; a numeral 24 refers to a user side condenser having a water circuit 24*a*; a reference numeral 25 designates an expansion device; a numeral 26 denotes a heat source side evaporator having a water circuit 26*a*; and a reference numeral 27 designates a coolant piping which connects the above-mentioned components 23, 24, 25 and 26 to form a refrigerating device B at the secondary side. Within the cycle of this refrigerating device B, there is filled Freon 12 (R12) as the cooling medium. Further, this secondary side cooling device B is constructed smaller in its capacity than that of the primary side heat-pump type refrigerating device A. A reference numeral 28 denotes a forward pipe for the heat source circuit, which connects the lower part of the cushion tank 14 and the inlet of the water circuit 26*a;* a numeral 29 refers to a return pipe for the heat source circuit, which connected the upper part of the cushion tank 14 and the outlet of the water circuit 26*a;* and numerals 30 and 31 respectively designate a circulating pump for the heat source and a check valve, both being provided in the forward pipe 28. The check valve 31 permits flow of water only in the direction of from the bottom of the cushion tank 14 to the evaporator 26 at the heat source side. A numeral 32 refers to a heating tank having a predetermined capacity; a reference numeral 33 designates a forwarding pipe for a hot water supply circuit, which connects the outlet of the water circuit 24*a* and the upper part of the heating tank 32; a reference numeral 34 denotes a return pipe for the hot water supply circuit, which connects the inlet of the water circuit 24*a* and the lower part of the heating tank 32; a numeral 35 refers to a circulating pump for hot water supply, which is provided in the return pipe 34, a numeral 36 refers to a water supply pipe with one end thereof being connected to the lower part of the heating tank 32 and the other end thereof being connected to a water supply source (not shown in the drawing); the numeral 37 refers a pressure reducing valve provided in the water supply pipe 36; the numeral 38 refers an outlet pipe for hot water supply, which is connected to the top part of the heating tank 32; a reference numeral 39 denotes the third electromagnetic valve provided in this outlet pipe 38; numerals 40 and 41 respectively refer to a safety valve and an automatic airvent provided in the outlet pipe 38 between the heating tank 32 and the third electromagnetic valve 39; and numerals 42 and 43 respectively refer to the first and second temperature detectors for hot water supply, which detect the temperature of the supply hot water in the upper and lower parts of the heating tank 32. The first temperature detector 42 is opened at a water temperature of, for example, 75° C. or below and closed at a temperature of 80° C. or above, while the second temperature detector 43 is opened at a water temperature of, for example, 80° C. or above, and closed at a temperature of 75° C. or below, thereby controlling operations of the hot water supply circulating pump 35 and opening/closing of the third electromagnetic valve 39. A reference numeral 44 denotes a hot water storing tank of a relatively large capacity, which is communicatively connected with the other end of the outlet pipe 38 at the upper part of the tank; a numeral 45 refers to a ball tap to close the outlet pipe 38 when the water level in the hot water storing tank 44 reaches a predetermined height; and a numeral 46 refers to a hot water supply cock for supplying hot water in the hot water storing tank 44 to various receiving points of the hot water.

Figure 2:
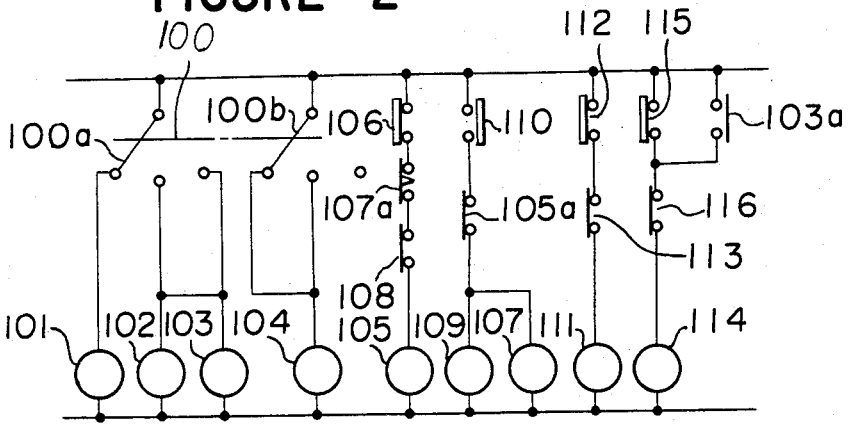
FIG. 2 is a control circuit diagram of circulating pumps and electromagnetic valves.

In the following, an electrical circuit for the system according to the present invention will be explained. FIG. 2 schematically illustrates a control circuit for the circulating pump and the electromagnetic valves. In the drawing, a reference numeral 100 designates a dipole operational mode selecting switch, each of change-over contacts 100*a*, 100*b* of which has a "supply only" contact for exclusive supply of hot water, a "warm-supply" contact for room warming and hot water supplying, and a "cool-supply" contact for room cooling and hot water supply. At the "supply only" contact of one of the change-over contacts 100*a*, there is connected a solenoid coil 101 for the second electromagnetic valve 12, and, at the "warm-supply" contact and the "cool-supply" contact thereof, there are respectively connected, in series, a solenoid coil 102 for the first electromagnetic valve 11 and the first realy 103. On the other hand, at the "supply only" contact and the "warm-supply" contact of the other change-over contact 100*b*, there is connected, in series, the second relay 104. A reference numeral 105 designates an electromagnetic contactor for the hot water supply circulating pump 35, which in connected in series with a serial circuit comprising a contact 106 of the second temperature detector 43 for the hot water supply, a contact 107*a* of a delaying relay 107, and the first O.C.R. 108 of a manual return type. A numeral 109 refers to a winding for the third electromagnetic valve 39, which is connected in parallel with the delaying relay 107. The winding 109 is connected in series with a serial circuit comprising a contact 110 of the first temperature detector 42 for the hot water supply and a constantly closed contact 105*a* of the electromagnetic contactor 105 for the hot water supply circulating pump 35. A reference numeral 111 denotes an electromagnetic contactor for the heat source circulating pump 30, which is connected in series with a serial circuit comprising a contact 112 of the cool water temperature detector 20 and the second O.C.R. 113 of a manual return type. A numeral 114 refers to an electromagnetic contactor for the air-conditioning circulating pump 16, which is connected in series with a serial circuit comprising a contact 115 of the warm water temperature detector 21 and the third O.C.R. 116 of a manual return type. This electromagnetic contacting device is also constructed in such a manner that the operation of the air-conditioning circulating pump 16 may be maintained, during the "room warming and hot water supplying" and the "room cooling and hot water supplying", by connection of a constantly opened contact 103*a* of the first relay 103 in parallel with the contact 115 of the warm water temperature detector 21.

Figure 3:
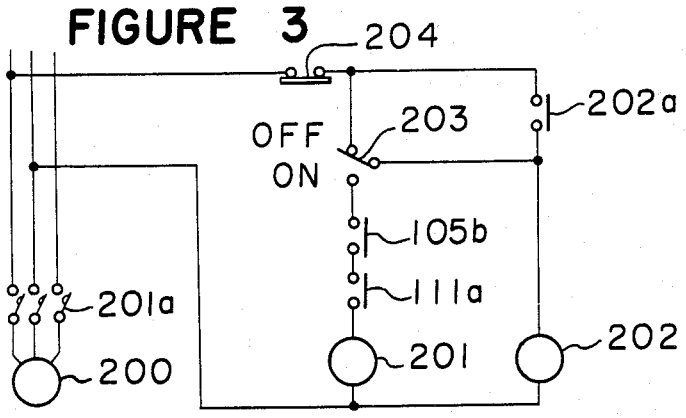
FIG. 3 is a control circuit diagram of the refrigerating device at the secondary side.

FIG. 3 illustrates a control circuit of the cooling device at the secondary side. In the drawing, a reference numeral 200 designates a compressor motor for driving the compressor 23; and a numeral 201 refers to an electromagnetic contactor having a contact 201*a* for the compressor motor 200. This electromagnetic contact device is connected in series with constantly opened contacts 105*b* and 111*a* of the electromagnetic contactors 105 and 111 for the hot water supply circulating pump 35 and the heat source circulating pump 30, respectively, thereby forming a drive circuit for the compressor motor 200. A reference numeral 202 designates a third relay connected in parallel with the above-mentioned drive circuit. The third relay can be selectively changed over to either of the above-mentioned drive circuit at the "ON" contact side or the "OFF" contact side by means of a manually operable switch 203, but it is self-ratched by a constantly open contact 202*a*. A numeral 204 refers to a protective switch for the compressor 23 such as a high pressure switch, and so forth.

Figure 4:
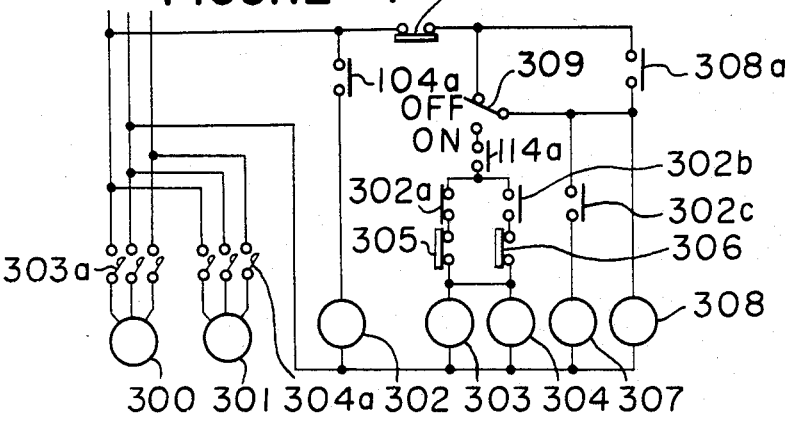
FIG. 4 is a control circuit diagram of the heat-pump type refrigerating device at the primary side.

FIG. 4 shows a control circuit for the heat pump type refrigerating device at the primary side. In the drawing, reference numerals 300 and 301 denote respectively an electric motor for the compressor 1 and an electric motor for the air blower 3*a;* a numeral 302 refers to a fourth relay for changing over from cooling to warming, or vice versa, which is connected in series with a constantly open contact 104*a* of the second relay 104; numerals 303 and 304 refer to electromagnetic contact devices for the compressor motor 300 and the air blower motor 301, respectively, which are connected in series with a parallel circuit composed of a constantly closed contact 302*a* of the fourth relay 302 and a contact 305 of the temperature detector 18 for cooling, and a first constantly open contact 302*b* of the fourth relay 302 and a contact 306 of the temperature detector 19 for warming. These electromagnetic contact devices 303 and 304 are respectively provided with a contact 303*a* for the compressor motor 300 and a contact 304*a* for the air blower motor 301. A reference numeral 307 denotes a winding for the four-way change-over valve 2, which constitutes a serial circuit with a second constantly open contact 302*c* of the fourth relay 302; a numeral 308 refers to a fifth relay which constitutes a parallel circuit with the above-mentioned serial circuit; and 309 represents a manually operable switch to perform selective change-over between the "ON" contact side at the electromagnetic contact devices 303 and 304 for the compressor motor 300 and the air blower motor 301 and the "OFF" contact side at the winding 307 for the four-way change-over valve and the fifth relay 308, through a constantly open contact 114*a* of the electromagnetic contactor 114 for the air-conditioning circulating pump 16. Owing to this manual switch 309, the fifth relay 308 can be self-sustained by its constantly open contact 308*a*, even when the change-over operation is effected by this manual switch 309 to the side of the electromagnetic contact devices 303 and 304. A reference numeral 310 represents a protective switch for the compressor 1 such as, for example, a high pressure switch, etc.

The air-conditioning and hot water supplying system of the above-described construction according to the present invention operates in the following manners.

In the case of the exclusive operation for hot water supply, the operational mode selecting switch 100 is first changed over to the "supply only" contact, and the manual switches 203 and 309 are changed over to their respective "ON" contact sides. As the result of this, the winding 101 for the second electromagnetic valve and the second relay 104 are energized in the circulating pump and the electromagnetic valve control circuit (FIG. 2), and the winding 102 for the first electromagnetic valve and the first relay 103 are de-energized, whereby the second electromagnetic valve 12 is opened and the first electromagnetic valve 11 is closed. Since the temperature of water in the air-conditioning circuit, the heat source circuit, and the hot water supply circuit, at the start of this operation, is at 15° C. or so in the middle of a seasonal period, the contact 110 of the first temperature detector 42 for hot water supply is opened and the contact 106 of the second temperature detector 43 for hot water supply is closed, while the contact 112 of the temperature detector 20 for cold water and the contact 115 of the temperature detector 21 for warm water are both closed. As the consequence of this, the electromagnetic contactors 105, 111 and 114 of the hot water supply circulating pump 35, the heat source circulating pump 30 and the air-conditioning circulating pump 16, respectively, are energized, whereby these respective pumps 35, 30 and 16 are driven, the third electromagnetic valve 39 is closed, and a circulation circuit as shown with a solid-line arrow in FIG. 1 is formed.

On the other hand, in the control circuit of the refrigerating device B at the secondary side (FIG. 3), the electromagnetic contactors 105 and 111 of the hot water supply circulating pump 35 and the heat source circulating pump 30, respectively, are energized as soon as the manual switch 203 is closed to the "ON" contact side, whereby the contacts 105*b* and 111*a* thereof are closed. Also, since the third relay 202 is energized prior to the change-over operation of the manual switch 203, and the contact 202*a* of the relay is closed to form the self-sustaining circuit, the electromagnetic contactor 201 of the compressor motor 200 is energized through the contact 202*a* of the third relay 202, the manual switch 203, and the contacts 105*b*, 111*a* of the electromagnetic contactors 105, 111 for the hot water supply circulating pump 35 and the heat source circulating pump 30, respectively, whereby the compressor motor 200 is driven and the refrigerating device B at the secondary side becomes operative.

Further, in the control circuit of the heat-pump type refrigerating device A at the primary side (FIG. 4), the contact 104*a* of the second relay 104 is closed by energization of the relay with the consequence that the fourth relay 302 is energized, and one of the contacts 302*a* thereof is opened, while the other contacts 302*b* and 302*c* thereof are closed. Moreover, by energization of the electromagnetic contactor 114 for the air-conditioning circulating pump 16, the contact 114*a* thereof is closed, and further the contact 306 of the temperature detector 19 for warming is closed. In addition, since the fifth relay 308 is energized prior to the change-over operation of the manual switch 309, and the contact 308*a* thereof is closed to form the self-sustaining circuit, the electromagnetic contact devices 303 and 304 of the compressor motor 300 and the air blower motor 301, respectively, are energized by way of the contact 308*a* of the fifth relay 308, the "ON" contact of the manual switch 309, the contact 114*a* of the electromagnetic contactor 114 of the air-conditioning circulating pump 16, and the contact 306 of the temperature detector 19 for warming, whereby the compressor motor 300 and the air blower motor 301 are put in driving. Simultaneously with this, the winding 307 for the four-way change-over valve 2 is energized by way of the contact 308*a* of the fifth relay 308 and the contact 302*c* of the fourth relay 302, whereby the four-way change-over valve 2 is shifted to a solid line position shown in FIG. 1. Accordingly, the heat-pump type refrigerating device A at the primary side operates in the "warming cycle".

In the case of the operation for the room warming and the hot water supplying, the change-over contacts 100*a* and 100*b* of the operational mode selection switch 100 are changed over to the "warm-supply" contact, which energizes both winding 102 for the first electromagnetic valve and the first relay 103, and de-energizes the winding 101 for the second electromagnetic valve. And, even when the first electromagnetic valve 11 is opened and the second electromagnetic valve 12 is closed, and, at the same time, the constantly open contact 103*a* is closed and the contact 115 of the temperature detector 21 for warm water is opened, the air-conditioning circulating pump 16 continues its operations. As for the control circuits for the circulating pump and the electromagnetic valves, the control circuit for the refrigerating device B at the secondary side, and the control circuit for the heat-pump type refrigerating device A at the primary side, the same applies as is the case with the exclusive operation for the hot water supply. Accordingly, there is formed a circulation circuit as shown with a dot-line arrow in FIG. 1.

That is to say, in the case of the exclusive operation for hot water supply and the operations for warming and hot water supply, the heat-pump type refrigerating device A at the primary side is in the "warming cycle", and, as is well known, since the heat source side heat-exchanger 3 functions as an evaporator, and the user side heat-exchanger 5 functions as a condenser, warm water at a temperature of approximately 45° C. to 55° C. can be obtained from the user side heat-exchanger 5. This warm water passes through the by-pass 10 and is supplied to the cushion tank 14 at the time of the exclusive operation for hot water supply, while it passes through the first connecting pipe 8 and is supplied to the fan coil unit 7 at the time of the operations for room warming and hot water supply, and, after the room warming, the warm water lowers its temperature to approximately 45° C., passes through the second connecting pipe 9 to flow into the cushion tank 14, and further passes through the third connecting pipe 15 to circulate into the user side heat-exchanger 5, thereby gradually storing warm water in the cushion tank 14. On the other hand, since a part of the warm water in the cushion tank 14 is caused to circulate into the heat source side evaporator 26 of the refrigerating device B at the secondary side by means of the heat source circulating pump 30, the refrigeratin device can be operated at a relatively high evaporating temperature, and high temperature water is obtained from the user side condenser 24 with high heating capability. In this case, when the inlet temperature of the water circuit 5*a* of the user side heat-exchanger 5 exceeds 50° C. in the heat-pump type refrigerating device A at the primary side, the temperature detector 19 for warming senses the temperature to open the contact 306 with the consequence that the electromagnetic contact devices 303 and 304 of the compressor motor 300 and the air blower motor 301, respectively, are de-energized, and the operation in the warming cycle is stopped. And, since the water temperature in the cushion tank 14 is 5° C. or so at the rising time for the warming operation, the temperature detector 20 for cool water senses out the temperature to open the contact 112 and to stop the heat source circulating pump 30 until the temperature within the cushion tank 14 will become 7° C. and above, while the air-conditioning circulating pump 16 alone is in operation. Also, when the temperature of the warm water within the cushion tank 14 increases to reach a temperature level of 45° C. and above, the temperature detector 21 for warm water senses out the temperature to open the contact 115, whereby the air-conditioning circulating pump 16 will stop its working in the exclusive operation for hot water supplying. In this case, the heat-pump type refrigerating device A at the primary side is given a large capacity so as to accommodate the maximum air-conditioning load. However, since the cushion tank 14 of a predetermined capacity is interposed in the system, there is no possibility of the water in the cushion tank increasing its temperature to 45° C. in a short period of time, whereby a short cycle operation of the heat-pump type refrigerating device A at the primary side is prevented. Further, in the case of hot water supplying, high temperature water can be fed if a condensing temperature (a condensing pressure) is increased. However, from the standpoint of mechanical strength of the devices for the refrigerating cycle, the design pressure thereof is generally set at 28 kg/cm$^2$G, and it is further designed to be kept at a value in the vicinity thereof, e.g., 26 kg/cm$^2$G or below.

In the following, comparison is given of the characteristics between Freon 12 (R12) and Freon 22 (R22) as the refrigerant to be filled in the refrigerating cycle in the case of using compressors of the same capacity. For example, at the condensing temperature of 65° C., the condensing pressure of Freon 12 (R12) is 16 kg/cm$^2$G and that of Freon 22 (R22) is 26.5 kg/cm$^2$G. At the same pressure level, for example, 26 kg/cm$^2$G, Freon 12 (R12) shows its condensing temperature of 88° C., while Freon 22 (R22) shows its condensing temperature of 64° C. Accordingly, with Freon 22 (R22), the warm water temperature for hot water supply is 60° C. or so at its maximum, while, with Freon 12 (R12), the water temperature can possibly be increased 85° C. or so. Further, at the condensing pressure of 26 kg/cm$^2$G, an evaporating temperature, at which the temperature of discharge gas from the compressor reaches its upper limit temperature (150° C.) is zero degree C. with Freon 12 (R12), while it is −15° C. or so with Freon 22 (R22). From this, it will be seen that Freon 22 (R22) is operable even if air, water or brine to be the heat source is at a temperature of from −5° to −10° C. or so, while Freon 12 (R12) is operable with these heat sources at a temperature range of from 5° to 10° C. at the lowest. Furthermore, as to the refrigerating capability of these refrigerants, Freon 12 (R12) is from 60 to 65% or so of Freon 22 (R22), when they are compared at the same evaporating temperature of, for example, 5° C.

From the above-mentioned comparative results, it can be said that Freon 12 (R12) has particularly good high temperature characteristic, and that Freon 22 (R22) is particularly excellent in its capability and low temperature characteristic. Accordingly, in the air-conditioning and hot water supply system according to the present invention, since Freon 22 (R22) is charged in the heat-pump type refrigerating device A at the primary side for the air-conditioning, and Freon 12 (R12) is filled in the refrigerating device B at the secondary side for the hot water supply, there can be attained efficient air-conditioning and high temperature water supply at as high a temperature as 85° C. or so.

And, the high temperature water obtained from the user side condenser 24 in the above-mentioned manner is gradually accumulated by means of the hot water supply circulating pump 35 into the heating tank 32 from its top part to the bottom. When the heating tank 32 interior is filled with high temperature water of 80° C. or so, the second temperature detector 43 for hot water supply senses out the temperature to open the contact 106 thereof, the electromagnetic contact device 105 of the hot water supply circulating pump 35 is de-energized to stop operation of the hot water supply circulating pump 35, and, at the same time, the contact point 105*a* of the electromagnetic contact device 105 is closed. As the result of this, the winding for the third electromagnetic valve 39 is energized to open the valve. Accordingly, low temperature water is fed from a water source (not shown in the drawing) into the heating tank 32 through the pressure reducing valve 37 and the water supply pipe 36, whereby the high temperature water is pushed upward from the bottom and fed into the hot water storing tank 44. In the course of this process, the second temperature detector 43 for hot water supply senses out the temperature to close the contact 106; however, since the delaying relay 107 has already been energized by the first temperature detector 42 for hot water supply, and the contact 107*a* thereof is opened in a couple of second after the energization, the hot water supply circulating pump 35 remains in stoppage. When the low temperature water is completely filled in the heating tank 32, the second temperature detector 42 for hot water supply detects the temperature to open the contact 110, to de-energize the delaying relay 107 to close the contact 107*a* thereof, and to resume operation of the hot water supply circulating pump 35. At the same time, the third electromagnetic valve 39 is closed and the hot water supply circuit becomes actuated again. In this way, since the hot water supply circulating pump 35 is not operated until the high temperature water in the heating tank 32 will have been forwarded to the hot water storing tank 44, there is no possibility of the high temperature water and the low temperature water in the heating tank 32 being agitated, whereby the high temperature water alone can be forwarded into the hot water storing tank 44.

On the other hand, in the case of the operations for room cooling and hot water supply, the change-over contacts 100*a* and 100*b* of the operational mode selection switch 100 are shifted to the side of the "cool-supply" contact, and the manual switches 203 and 309 are shifted to the side of the "ON" contact. As the result of this, the first electromagnetic valve 11 is opened and the second electromagnetic valve 12 is closed in the control circuit for the circulating pump and the electromagnetic valve (FIG. 2), as is the case with the operations for room warming and hot water supply. Further, the water temperature in the air-conditioning circuit, the heat source circuit, and the hot water supply circuit is 25° C. or so with the consequence that the hot water supply circulating pump 35, the heat source circulating pump 30, and the air-conditioning circulating pump 16 are put in operation accordingly, whereby the third electromagnetic valve 39 is closed to form the circulating circuit shown by the broken line arrow in FIG. 1. Incidentally, the control circuit (FIG. 3) of the refrigerating device B at the secondary side operates in exactly the same manner as in the aforedescribed operations for room warming and hot water supply.

Further, in the control circuit (FIG. 4) of the heat-pump type refrigerating device A at the primary side, the second relay 104 is de-energized by the change-over of the operational mode selection switch 100, so that its constantly open contact 104*a* is in an open condition and the fourth relay 302 is de-energized. As the consequence of this, the constantly closed contact 302*a* of the fourth relay 302 is in a closed condition, the constantly open contact 302*b* thereof is in an open condition, and the electromagnetic contact devices for the compressor motor 300 and the air-blower motor 301 are controlled by the contact 305 of the temperature detector 18 for cooling, whereby the compressor motor 300 and the air-blower motor 301 are driven. Simultaneously with this, since the constantly open contact 302*c* of the furth relay 302 becomes open, the winding 307 for the four-way change-over valve 2 is de-energized, and the four-way change-over valve 2 is shifted to a position in dot line as shown in FIG. 1. In other respects, the control circuit operates in the same manner as the operations for room warming and hot water supply, hence the heat-pump type refrigerating device A at the primary side operates in the "cooling cycle". That is to say, the heat source side heat-exchanger 3 functions as the condenser and the user side heat-exchanger 5 functions as the evaporator, as has already been well known, so that cold water of about 10° C. can be obtained from the user side heat-exchanger 5, and this cold water is circulated to the fan coil unit 7 to carry out the room cooling. And, from this fan coil unit 7, cool water of about 15° C. is circulated to the cushion tank 14 and further to the user side heat-exchanger 5, while a part of the cold water in the cushion tank 14 is circulated to the heat source side heat-exchanger 26 of the refrigerating device B at the secondary side.

In this case, the water temperature to the heat source side heat-exchanger 26 is lower than that at the time of the operations for room warming and hot water supply, so that the heating capacity of the refrigerating device B at the secondary side is small. However, since the water temperature in the heating tank 32 is primarily as high as 25° C. or so, a high temperature water of 80° C. or so can be filled in the heating tank 32 in a substantially equal length of time as that of the operations for the room warming and hot water supply.

Moreover, when the inlet temperature of the water circuit 5*a* in the user side heat-exchanger 5 of the heat-pump type refrigerating device A at the primary side becomes lower than 12° C., the temperature detector 18 for cooling detects the temperature to open the contact 305, the compressor motor 300 and the air-blower motor 301 cease their driving, and the operations for the cooling cycle stop. However, since the contacts 112 and 115 of the temperature detectors 20 and 21 for cool water and warm water, respectively, remain closed, both air-conditioning and heat source circulating pumps 16 and 30 continue their operations, whereby the room cooling by the refrigerating device B at the secondary side alone is performed. When the inlet temperature of the water circuit 5*a* increases to 15° C. and above due to increase in the cooling load, and other reasons, the temperature detector 18 for cooling senses out the temperature to again operate the heat-pump type refrigerating device A at the primary side, thereby carrying out the cooling operation. In this system, accordingly, since the room cooling is carried out by the refrigerating device B at the secondary side at the time of decrease in the cooling load, while the operation for the hot water supplying is being done, the system of the present invention contributes to energy saving. Incidentally, the same result can be obtained even if the heat source side heat-exchanger 3 is of the water cooling type. Furthermore, when the system is used at a place where the air-conditioning load is small, the capacity of the refrigerating device at the primary side can be small, hence the cushion tank 14 is not always required in this case, and the short cycle operation of the refrigerating device at the primary side can be possibly avoided by the heat capacity in the air-conditioning circuit.

In the embodiment of the invention, thermostats are preferably used as the temperature detectors 18 and 19 and solenoids are also preferably used as the first, second and third electromagnetic valves 11, 12 and 39.

Furthermore, the refrigerant in the refrigerating devices at both primary and secondary sides is not limited to Freon 22 (R22) and Freon 12 (R12), but any other refrigerants having the same characteristics as those of Freon 22 and Freon 12 may equally be utilized for the purpose of the present invention.

As mentioned in the foregoing, the air-conditioning and hot water supply system according to the present invention makes it possible to obtain the hot water supply in full electrical manner by combination of two units of the refrigerating devices, wherein the heat-pump type refrigerating device at the primary side is used for the air-conditioning, and cold or warm water after the air-conditioning operation is used as the heat source water for the refrigerating device at the secondary side to heat the water for the hot water supply, so that, in the case of the warming operation, the potential heat in the warm water after the room warming can be effectively utilized for heating water for the hot water supply, and, in the case of the cooling operation, the heat of the circulating water, which the fan coil unit has absorbed in the course of the cooling operation, can be used as the heat source for the refrigerating device at the secondary side, and yet this circulating water is cooled by the refrigerating device at the secondary side, the cooling capacity of the system as a whole increases, and the load imposed on the heat-pump type refrigerating device at the primary side can thereby be lessened.

In the foregoing, the air-conditioning and hot water supply system according to the present invention has been described in particular details in reference to the accompanying drawing showing a preferred embodiment thereof. It should, however, be noted that this embodiment is merely illustrative and not so restrictive, and that any changes and modifications may be made to every portions in the system without departing from the spirit and scope of the present invention as recited in the appended claim.

What is claimed is:

1. An air-conditioning and hot water supply system, which comprises:

(a) a reversible heat pump type refrigerating device at the primary side having a user side heat-exchanger and a heat source side heat-exchanger with a coolant of excellent low temperature characteristic being filled in both of said user side heat exchanger and said heat source side heat exchanger;

(b) a refrigerating device at the secondary side having a user side condenser for heating water for hot water supply and a heat source side evaporator with a coolant of excellent high temperature characteristic being filled in both of said user side condenser and said heat source side evaporator;

(c) a circuit for air-conditioning, through which cold or warm water is caused to circulate between said user side heat exchanger of said primary side heat pump and said heat source side evaporator of said secondary side refrigerating device;

(d) a fan coil unit for air-conditioning communicatively connected with said circuit for air-conditioning, (e) means for transporting said water in said circuit for air-conditioning from said user side heat exchanger of said primary side heat pump to said fan coil unit and thereafter to said heat source side evaporator of said secondary side refrigerating device; and (f) circulating means for causing the circulation of said water in said circuit for air-conditioning.

2. An air-conditioning and hot water supply system according to claim 1 wherein a by-pass circuit is provided in said circuit for air-conditioning to feed water from said user side heat-exchanger of said heat pump type refrigerating device at the primary side to said heat source side evaporator of said refrigerating device at the secondary side, without supplying water to said fan coil units.

3. An air-conditioning and hot water supply system according to claim 1 wherein temperature detectors are provided in said circuit for air-conditioning at the inlet side of said heat pump type refrigerating device to control operation of the same.

4. An air-conditioning and hot water supply system according to claim 1 wherein said coolant used for said heat pump type refrigerating device at the primary side is Furon 22 (R22) and said coolant used for said refrigerating device at the secondary side is Furon 12 (R12).

5. An air-conditioning and hot water supply system according to claim 3 wherein said temperature detectors provided at the inlet side of said heat pump type refrigerating device detect temperature lower than a predetermined temperature to stop the operation of said heat means type refrigerating device and cause said circulating pumps to operate whereby the operation of said refrigerating device at the secondary side alone is performed.

6. An air-conditioning and hot water supply system according to claim 1, wherein said circuit for air-conditiong further comprises:

a cushion tank;

a forwarding pipe for introducing into said cushion tank water from said user side heat exchanger of said primary side heat pump and from said fan coil unit;

a return pipe for drawing water from said cushion tank and feeding said water toward said user side heat exchanger of said primary side heat pump; and first and second cushion tank temperature detectors disposed in said cushion tank for controlling said circulating means of said circuit for air-conditioning.

7. An air-conditioning and hot water supply system according to claim 6, wherein said circulating means of said circuit for air-conditioning further comprises a first circulating pump connected between said primary side heat pump and said cushion tank and further comprises a second circulating pump connected between said heat source side evaporator of said secondary side refrigerating device and said cushion tank.

8. An air-conditioning and hot water supply system according to claim 7 wherein said first and second circulating pumps are controlled by said first and second cushion tank temperature detectors.

9. An air-conditioning and hot water supply system according to claim 1, further comprising a heating tank connected to said user side condenser of said refrigerating device at the secondary side so as to form a hot water supply circulating path therebetween, and further comprising a hot water supply circulating pump in said hot water supply circulating path.

10. An air-conditioning and hot water supply system according to claim 9 wherein first and second heating tank temperature detectors are provided in said heating tank to control the operation of said hot water supply circulating pump.

11. An air-conditioning and hot water supply system according to claim 10 wherein said first and second heating tank temperature detectors actuate a first valve to introduce cold water from a water source to said heating tank and a second valve to feed hot water in said heating tank to a hot water supply.

* * * * *